US011247223B2

(12) United States Patent
Huang

(10) Patent No.: US 11,247,223 B2
(45) Date of Patent: Feb. 15, 2022

(54) DIRECTION-ADJUSTABLE SHOWER HEAD FIXING STRUCTURE

(71) Applicant: XIAMEN LUXAR HOMEWARES CO., LTD., Xiamen (CN)

(72) Inventor: Lieyong Huang, Xiamen (CN)

(73) Assignee: Lieyong Huang, Fujian (CN)

( * ) Notice: Subject to any disclaimer, the term of this patent is extended or adjusted under 35 U.S.C. 154(b) by 277 days.

(21) Appl. No.: 16/503,616

(22) Filed: Jul. 4, 2019

(65) Prior Publication Data

US 2020/0360955 A1 Nov. 19, 2020

(30) Foreign Application Priority Data

May 14, 2019 (CN) ..... 201910398681.4

(51) Int. Cl.
*B05B 15/654* (2018.01)
*B05B 15/68* (2018.01)
*B05B 1/18* (2006.01)

(52) U.S. Cl.
CPC ..... *B05B 15/654* (2018.02); *B05B 15/68* (2018.02); *B05B 1/185* (2013.01)

(58) Field of Classification Search
CPC ..... E03C 1/0408; E03C 1/0409; E03C 2001/026; E03C 2001/0417; E03C 2001/0416; F16K 31/60; F16K 11/02; A47K 3/28; A47K 2201/02; F16C 11/06; F16C 11/106; B05B 15/654–15/68; B05B 1/18; B05B 1/185
See application file for complete search history.

(56) References Cited

U.S. PATENT DOCUMENTS

2002/0113145 A1* 8/2002 Wong ..... B05B 15/40 239/446
2005/0263617 A1* 12/2005 Thong ..... B05B 1/1636 239/383
2007/0253764 A1* 11/2007 Clayton ..... A47L 13/24 403/122
2019/0083991 A1* 3/2019 Lin ..... B05B 15/65
2020/0156090 A1* 5/2020 Lin ..... B05B 1/1681

* cited by examiner

*Primary Examiner* — Tuongminh N Pham
(74) *Attorney, Agent, or Firm* — Leong C. Lei

(57) ABSTRACT

A direction-adjustable shower head fixing structure includes a shower head main body and a connecting seat. The shower head main body is movably connected to the connecting seat through a connecting structure. The connecting structure includes a ball joint fixed to the connecting seat and a locking mechanism disposed in the shower head main body and cooperating with the ball joint. After connected, the shower head main body is rotatable about a ball head of the ball joint to adjust the spray angle of the shower head. Through the locking mechanism to hold or release the ball head quickly, the shower head can be taken or fixed conveniently.

8 Claims, 8 Drawing Sheets

DIRECTION-ADJUSTABLE SHOWER HEAD FIXING STRUCTURE

BACKGROUND OF THE INVENTION

1. Field of the Invention

The present invention relates to sanitary products, and more particularly to a direction-adjustable shower head fixing structure.

2. Description of the Prior Art

A wall-mounted shower head is usually mounted on the wall through a wall bracket. In order to take the shower head from the wall, the shower head and the wall bracket are connected by a holder. The holder and the shower head are detachably connected. In general, the holder is rotatably connected to the wall bracket, which is beneficial to adjust the spray angle of the shower head. Chinese Patent Publication No. CN 207295860 U discloses a hand-held shower head holder. When the user wants to adjust the shower head, the shower head is first removed and then the holder is rotated. This has to be repeated several times for a suitable position. The operation is relatively complicated, or the holder is directly rotated. The operation is awkward and laborious. The wall-mounted shower head is always installed at a high position. If the user is not tall enough, it is very inconvenient to adjust the shower head, especially for the elderly or children. Accordingly, the inventor of the present invention has devoted himself based on his many years of practical experiences to solve these problems.

SUMMARY OF THE INVENTION

The primary object of the present invention is to provide a direction-adjustable shower head fixing structure, which can adjust the spray angle of the shower head. The operation is easy, convenient and labor-saving. The shower head can be taken and fixed quickly.

In order to achieve the above object, the present invention adopts the following technical solutions:

A direction-adjustable shower head fixing structure comprises a shower head main body and a connecting seat. The shower head main body is movably connected to the connecting seat through a connecting structure. The connecting structure comprises a ball joint fixed to the connecting seat and a locking mechanism disposed in the shower head main body for holding or releasing the ball joint.

Preferably, the connecting seat has a connecting end for connecting the shower head main body. The ball joint of the connecting structure is fixedly connected to the connecting end. A ball head of the ball joint extends out of the connecting end. A top of the shower head main body has an opening through which the ball head of the ball joint passes.

Preferably, the locking mechanism includes a fixing base, a handle, a torsion spring, and a button. The fixing base is disposed under the opening of the shower head main body. A ball seat is formed on the fixing base. A receiving hole is formed in a middle portion of the ball seat for receiving the ball head. A side wall of the ball seat is formed with a notch communicating with the receiving hole. The handle is movably connected to the notch. A front end of the handle is located in the notch. The front end of the handle is formed with a pressing portion. A front end of the pressing portion has a concave curved surface. Two ends of the torsion spring act on the handle and the ball seat, respectively. The button is disposed above the handle for driving the handle. When the handle is actuated, the front end of the handle is driven to hold or release the ball head.

Preferably, a middle portion of the handle is pivotally connected to the ball seat through a connecting pin. A first pivot hole is defined in the middle portion of the handle. The ball seat is provided with a pivot seat having a second pivot hole. The connecting pin sequentially passes through the second pivot hole of the pivot seat and the first pivot hole of the handle, so that the handle is pivotally connected to the ball seat to be moved up and down about a pivot point.

Preferably, the torsion spring is insertedly disposed on the connecting pin.

Preferably, an inner side of the button is provided with an engaging claw. The handle is provided with an engaging hole corresponding to the engaging claw. The button is coupled to the handle through the engaging claw to be engaged with the engaging hole.

Preferably, an inner wall of the receiving hole of the ball seat has a curved surface.

Preferably, a limiting block is provided in the receiving hole of the ball seat. A bottom of the ball head is provided with a limiting groove. The limiting groove and the limiting block are configured to limit a relative rotation range of the ball head.

Preferably, a top of the button is exposed outside the shower head main body. The shower head main body is provided with a button hole corresponding to the button.

Preferably, an inner wall of the receiving hole of the ball seat and the front end of the pressing portion of the handle are provided with anti-slip pads.

With the above structure, the shower head main body of the present invention is movably connected to the connecting seat through the connecting structure composed of the ball joint and the locking mechanism. After connected, the shower head main body is rotatable about the ball head of the ball joint to adjust the spray angle of the shower head. The operation is easy, convenient and labor-saving. The locking mechanism can hold or release the ball head quickly, which is beneficial to take or fix the shower head.

DETAILED DESCRIPTION OF THE PREFERRED EMBODIMENTS

Figure 1:
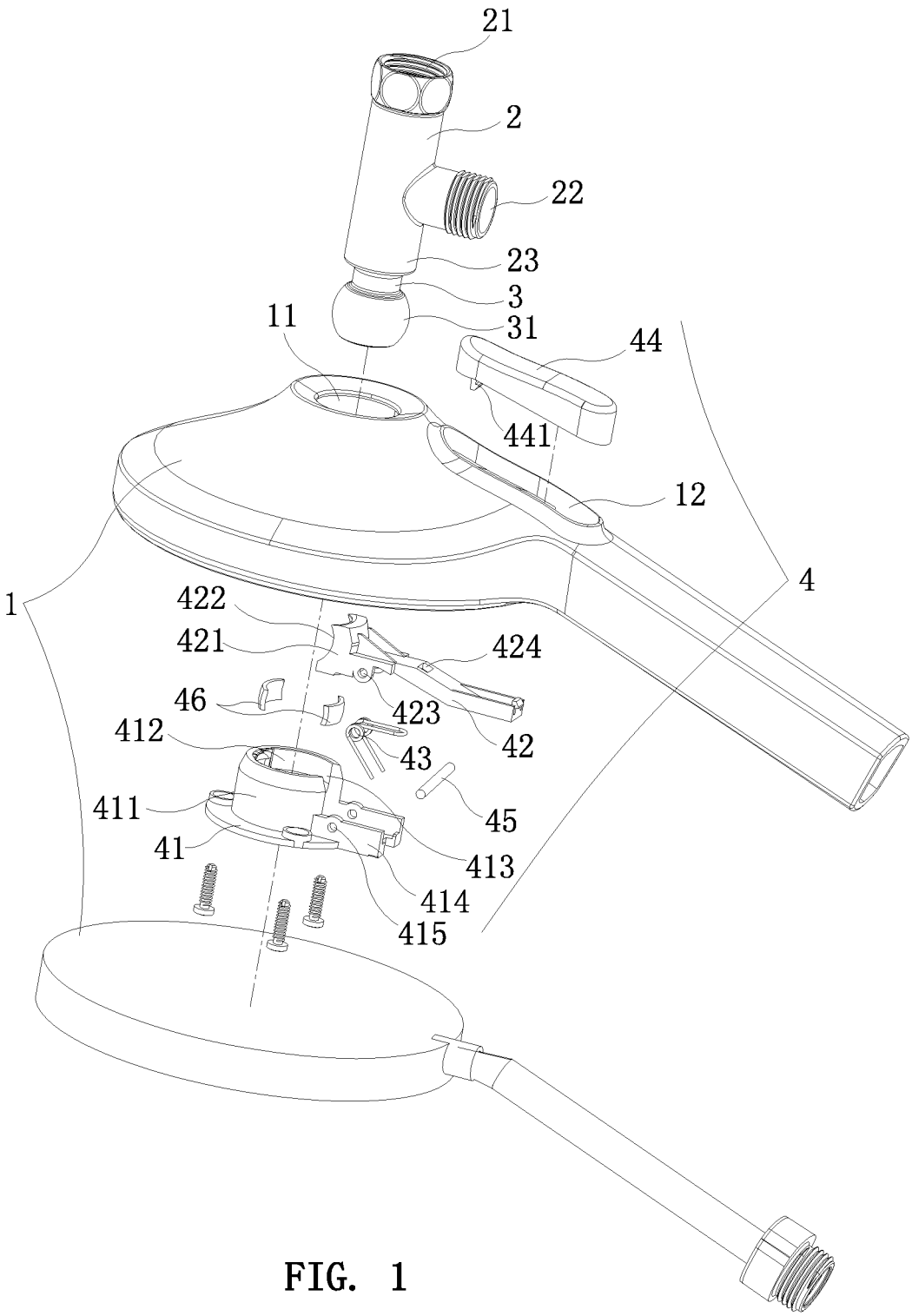
FIG. 1 is an exploded view of the present invention.
Figure 2:
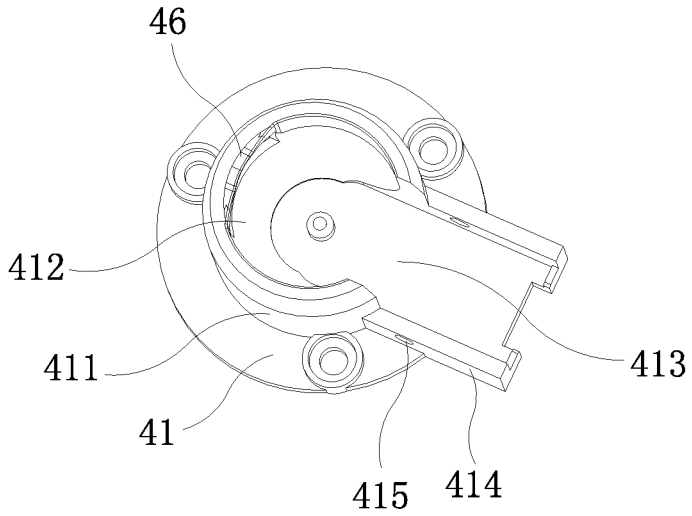
FIG. 2 is a perspective view of the fixing base of the present invention.
Figure 3:
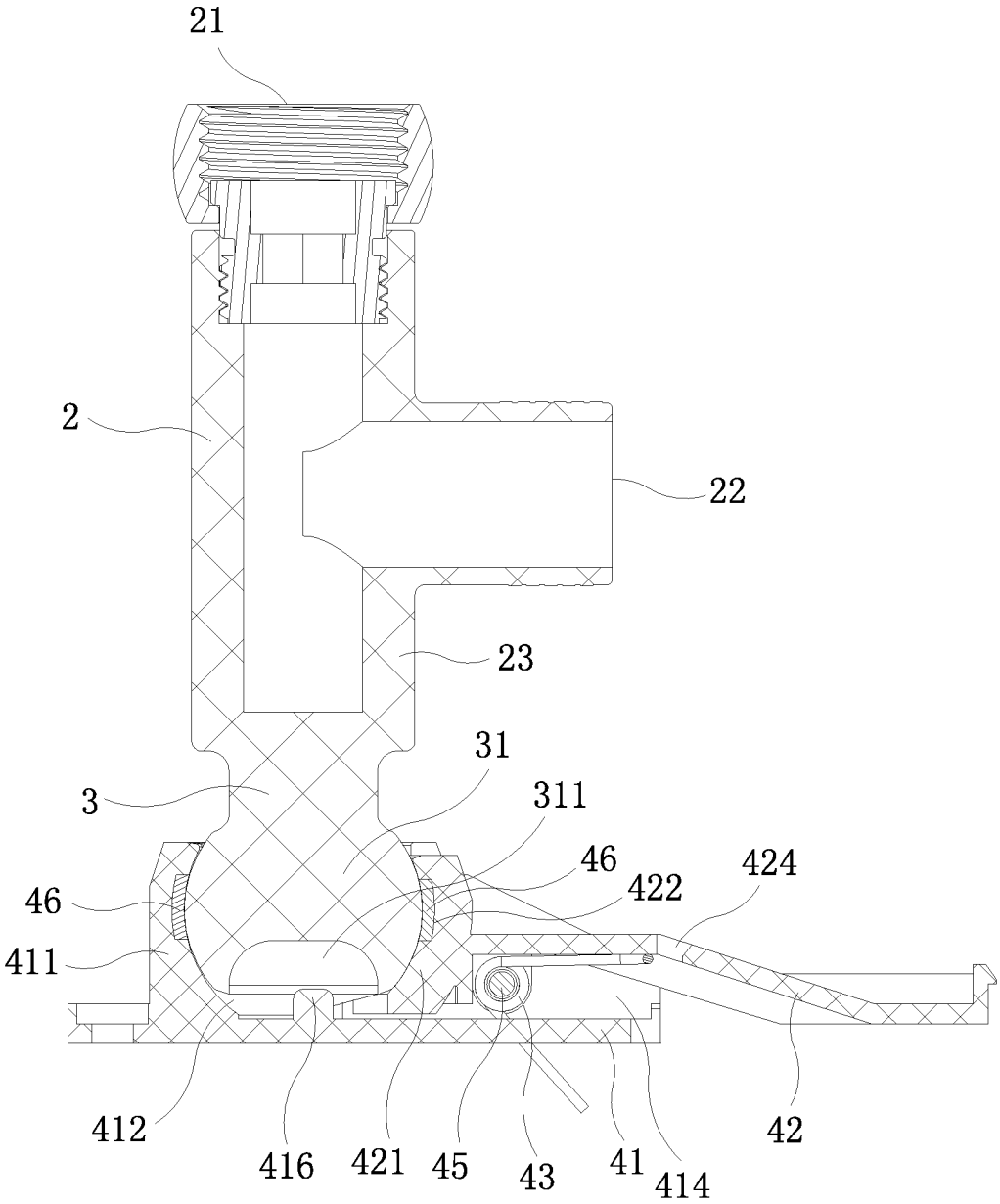
FIG. 3 is a cross-sectional view of the ball joint and the locking mechanism of the present invention.
Figure 4:
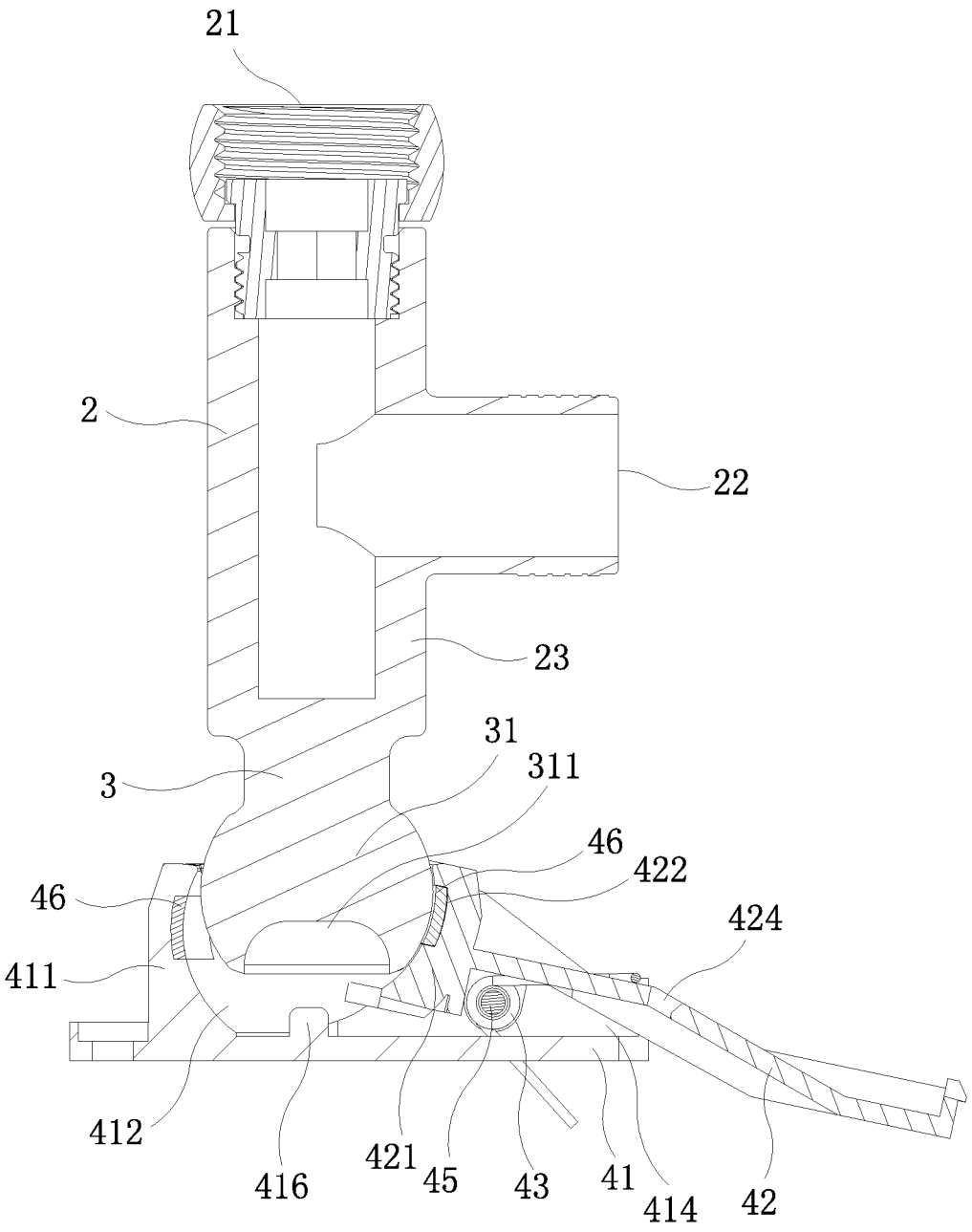
FIG. 4 is a cross-sectional view showing a state in which the locking mechanism releases the ball joint of the present invention.
Figure 5:
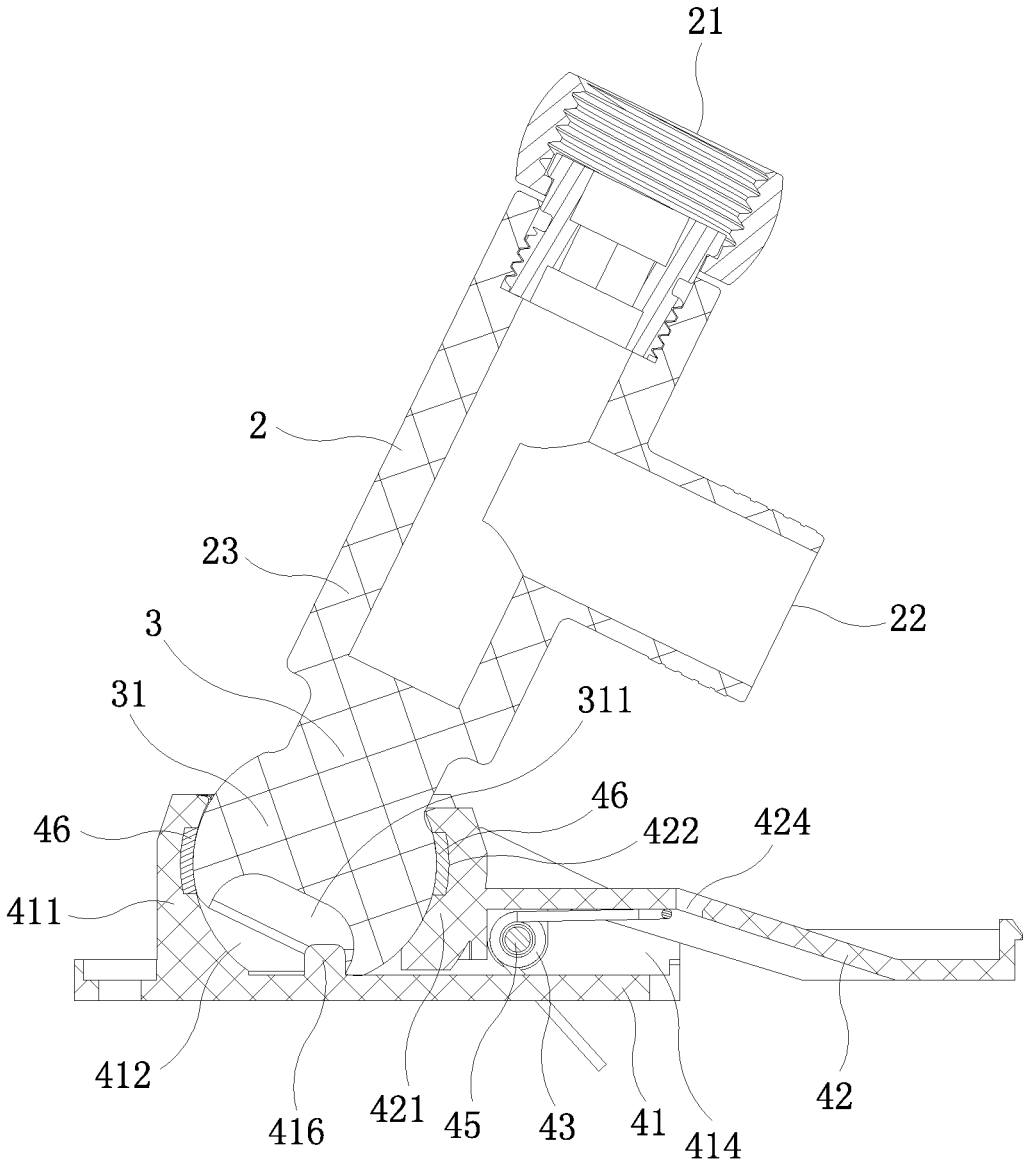
FIG. 5 is a schematic view showing that the present invention is rotated and adjusted about the ball joint.
Figure 6:
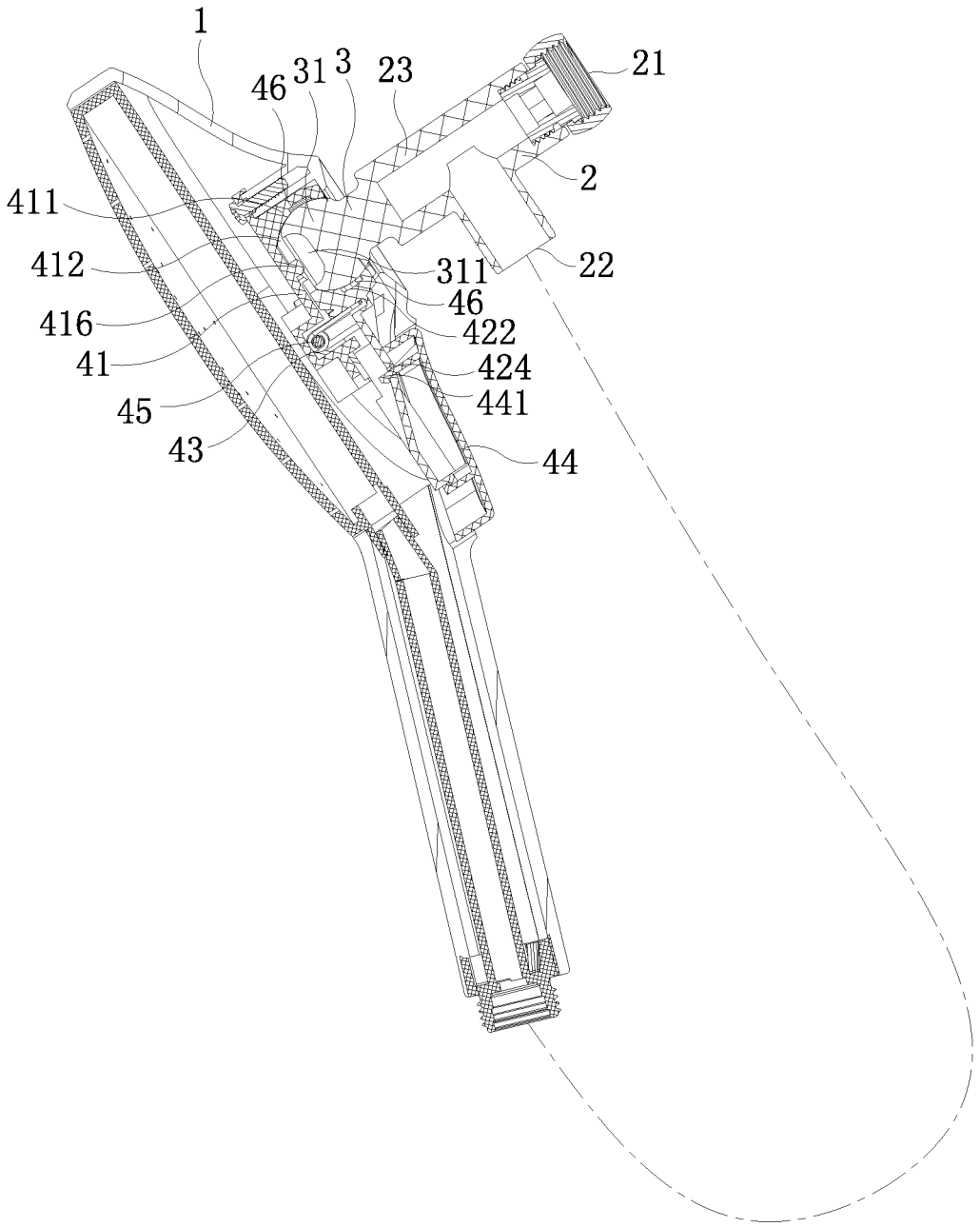
FIG. 6 is a schematic view of the implementation of the present invention, showing that the shower head main body is connected to the connecting seat.

Embodiments of the present invention will now be described, by way of example only, with reference to the accompanying drawings.

Referring to FIG. 1 through FIG. 8, the present invention discloses a direction-adjustable shower head fixing structure, comprising a shower head main body 1 and a connecting seat 2. The shower head main body 1 is movably connected to the connecting seat 2 through a connecting structure. The connecting seat 2 may be positioned on a wall or a shower rod. The connecting structure comprises a ball joint 3 and a locking mechanism 4.

The connecting seat 2 is a three-way structure. The upper end of the connecting seat 2 has a water inlet for communicating with a water source. The side of the connecting seat 2 has a water outlet 22 connected to a water inlet end of the shower head main body 1 through a hose. The lower end of the connecting seat 2 has a connecting end 23 coupled to the shower head main body 1. The ball joint 3 of the connecting structure is fixedly connected to the connecting end 23. A ball head 31 of the ball joint 3 extends out of the connecting end 23. The top of the shower head main body 1 has an opening 11 through which the ball head 31 of the ball joint 3 passes. The locking mechanism 4 is disposed in the shower head main body 1 below the opening 11 for holding or releasing the ball head 31 of the ball joint 3.

In a preferred embodiment of the present invention, as shown in FIG. 1, the locking mechanism 4 includes a fixing base 41, a handle 42, a torsion spring 43, and a button 44. The fixing base 41 is correspondingly disposed under the opening 11 of the shower head main body 1, and can be locked to the top of the shower head main body 1 by means of a screw thread. A ball seat 411 is formed on the fixing base 41. A receiving hole 412 is formed in the middle portion of the ball seat 411 for receiving the ball head 31. The inner wall of the receiving hole 412 has a curved surface. The side wall of the ball seat 411 is formed with a notch 413 extending downward from the top the ball seat 411 and communicating with the receiving hole 412, so that the ball seat 411 is C-shaped. The handle 42 is pivotally connected to the notch 413 of the ball seat 411. The front end of the handle 42 is located in the notch 413. The front end of the handle 42 is formed with a pressing portion 421 corresponding in size to the notch 413. The front end of the pressing portion 421 has a concave curved surface 422 matching the surface of the ball head 31. The middle portion of the handle 42 is pivotally connected to the ball seat 411 through a connecting pin 45. A first pivot hole 423 is defined in the middle portion of the handle 42. The ball seat 411 is provided with a pivot seat 414 having a second pivot hole 415. The connecting pin 45 sequentially passes through the second pivot hole 415 of the pivot seat 414 and the first pivot hole 423 of the handle 42, so that the handle 42 is coupled to the ball seat 411. The torsion spring 43 is insertedly disposed on the connecting pin 45. Two ends of the torsion spring 43 act on the handle 42 and the ball seat 411, respectively. The button 44 is disposed above the handle 42. The handle 42 swings up and down about the pivot point under the action of the button 44 and the torsion spring 43 to drive the pressing portion 421 at the front end of the handle 42 to hold or release the ball head 31 of the ball joint 3. The inner side of the button 44 is provided with an engaging claw 441. The handle 42 is provided with an engaging hole 424 corresponding to the engaging claw 441. The button 44 is coupled to the handle 42 through the engaging claw 441 to be engaged with the engaging hole 424. The top of the button 44 is exposed outside the shower head main body 1. The shower head main body 1 is provided with a button hole 12 through which the button 44 is exposed. Furthermore, the inner wall of the receiving hole 412 of the ball seat 411 and the concave curved surface 422 at the front end of the pressing portion 421 are provided with anti-slip pads 46 to prevent a slip and provide a stable connection. The bottom surface of the ball seat 411 is provided with a limiting block 416. The bottom of the ball head 31 of the ball joint 3 is provided with a limiting groove 311. The limiting groove 311 and the limiting block 416 define a relative rotation range, thereby preventing the rotation angle from being excessively large to cause the ball head 31 to come out.

Figure 7:
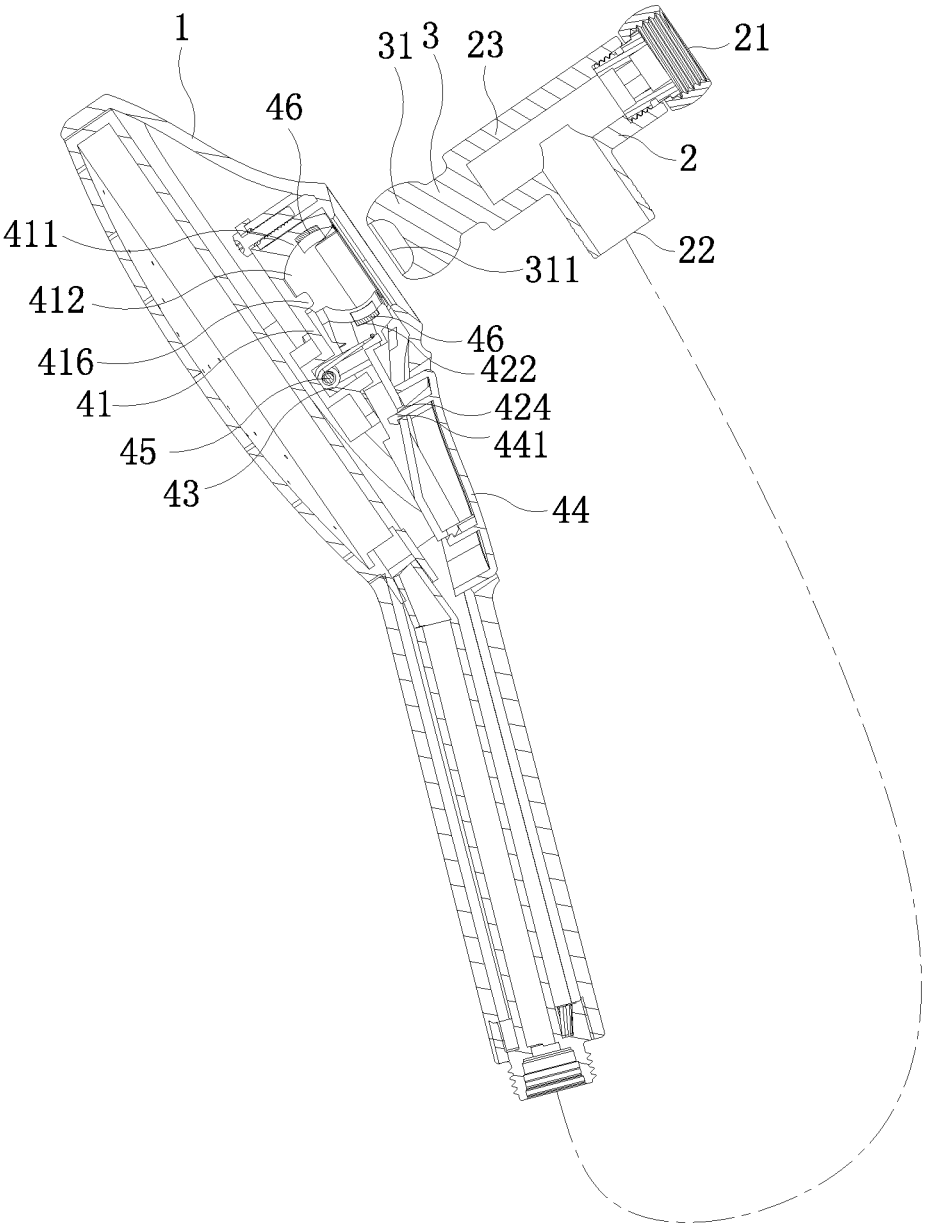
FIG. 7 is a schematic view of the implementation of the present invention, showing that the shower head main body is disconnected from the connecting seat.
Figure 8:
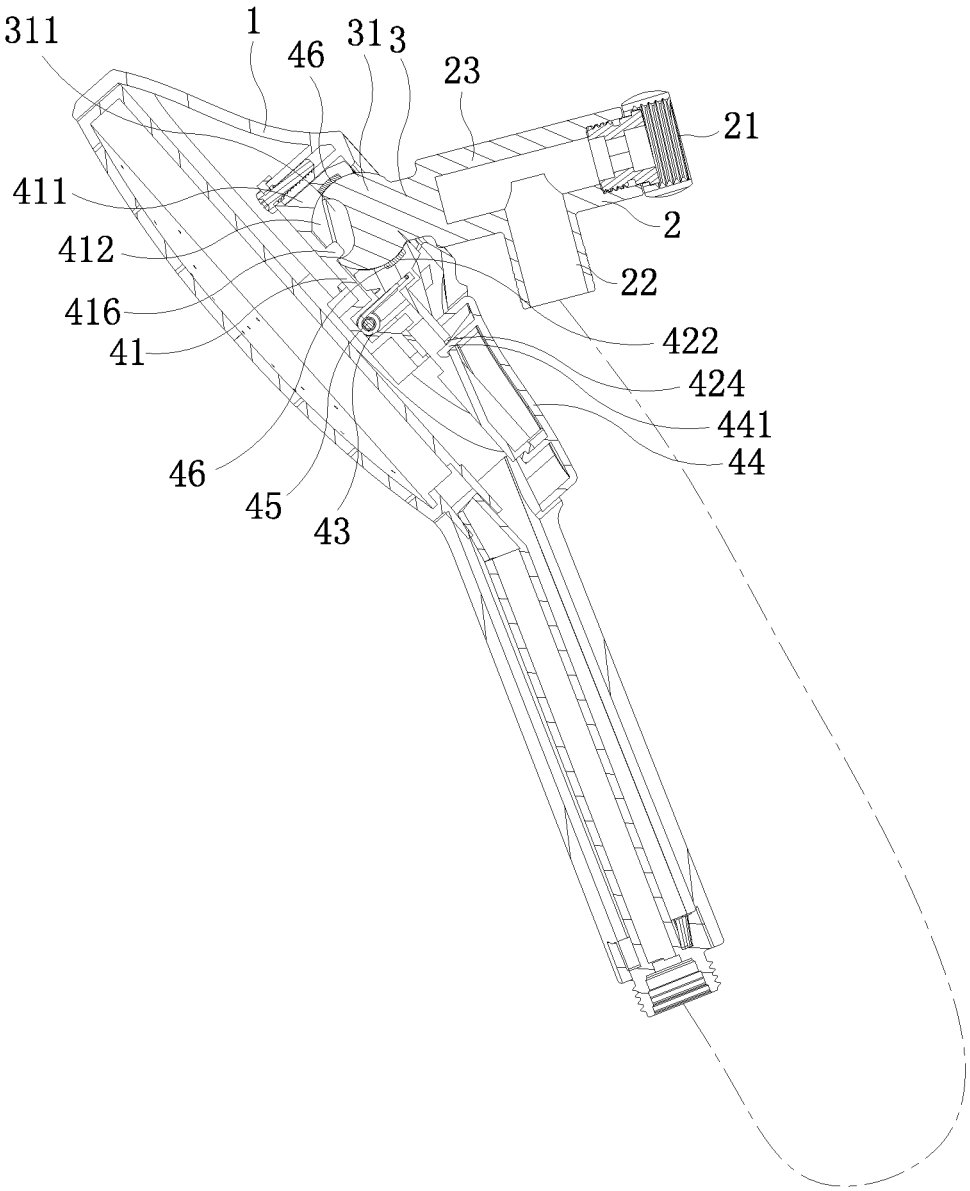
FIG. 8 is a schematic view of the implementation of the present invention, showing that the shower head main body is rotatable relative to the connecting seat.

In this embodiment, when the shower head main body 1 is connected to the connecting seat 2, the button 44 is pressed down to pivot the handle 42 about the pivot point (clockwise), and the torsion spring 43 accumulates energy. The handle 42 is pivoted to move the pressing portion 421 at the front end upward to disengage from the notch 413 of the ball seat 411. Then, the ball head 31 of the ball joint 3 is inserted through the opening 11 of the top of the shower head main body 1 into the receiving hole 412 of the ball seat 411. When the button 44 is released, the handle 42 is pivoted and returned reversely (counterclockwise) by the elastic force of the torsion spring 43, and the pressing portion 421 at the front end of the handle 42 is pivoted downwardly about the pivot point to hold the ball head 31, so that the shower head main body and the connecting seat are connected together (see FIG. 6). After connected, the shower head main body 1 is rotatable about the ball head 31 to adjust the spray angle of the shower head (see FIG. 8). For separation, as shown in FIG. 7, the button 44 is pressed again, the pressing portion 421 at the front end of the handle 42 is moved upward to release the ball head 31, the shower head main body 1 is pulled downward, and the ball head 31 is disengaged from the opening 11 of the top of the shower head main body 1, that is, the shower head main body 1 can be disengaged from the connecting seat 2.

As can be seen from the above, the shower head main body of the present invention is movably connected to the connecting seat through the connecting structure composed of the ball joint and the locking mechanism. After connected, the shower head main body is rotatable about the ball head of the ball joint to adjust the spray angle of the shower head. The operation is easy, convenient and labor-saving. The locking mechanism can hold or release the ball head quickly, which is beneficial to take or fix the shower head.

Although particular embodiments of the present invention have been described in detail for purposes of illustration, various modifications and enhancements may be made without departing from the spirit and scope of the present invention. Accordingly, the present invention is not to be limited except as by the appended claims

What is claimed is:

1. A direction-adjustable shower head fixing structure, comprising a shower head main body and a connecting seat, the shower head main body being movably and detachably connected to the connecting seat through a connecting structure so that the shower head main body is removable and separated from the connecting seat, the connecting structure comprising a ball joint fixed to the connecting seat and a locking mechanism disposed in the shower head main body for holding or releasing the ball joint;

wherein the connecting seat comprises a connecting end for connecting to the shower head main body, and the ball joint of the connecting structure is fixedly connected to the connecting end such that a ball head of the ball joint extends out of the connecting end, a top of the shower head main body having an opening through which the ball head of the ball joint is insertable; and wherein the connecting seat comprises a water inlet opening for connection with a water source and a water outlet opening for connection with the shower head main body, wherein the connecting seat is partly hollowed to define a water passage connected between the water inlet opening and the water outlet opening to supply water from the water inlet opening to the water outlet opening for feeding the water to the shower head main body through the connection between the water outlet opening and the shower head main body, the connecting end of the connecting seat being a solid portion of the connecting seat;

wherein the locking mechanism includes a fixing base, a handle, a torsion spring, and a button; the fixing base is disposed under the opening of the shower head main body, a ball seat is formed on the fixing base, a receiving hole is formed in a middle portion of the ball seat for receiving the ball head, a side wall of the ball seat is formed with a notch communicating with the receiving hole, the handle is movably connected to the notch, a front end of the handle is located in the notch, the front end of the handle is formed with a pressing portion, a front end of the pressing portion has a concave curved surface, two ends of the torsion spring act on the handle and the ball seat respectively, the button is disposed above the handle for driving the handle, when the handle is actuated, the front end of the handle is driven to hold or release the ball head.

2. The direction-adjustable shower head fixing structure as claimed in claim 1, wherein a middle portion of the handle is pivotally connected to the ball seat through a connecting pin, a first pivot hole is defined in the middle portion of the handle, the ball seat is provided with a pivot seat having a second pivot hole, and the connecting pin sequentially passes through the second pivot hole of the pivot seat and the first pivot hole of the handle, so that the handle is pivotally connected to the ball seat to be moved up and down about a pivot point.

3. The direction-adjustable shower head fixing structure as claimed in claim 2, wherein the torsion spring is insertedly disposed on the connecting pin.

4. The direction-adjustable shower head fixing structure as claimed in claim 1, wherein an inner side of the button is provided with an engaging claw, the handle is provided with an engaging hole corresponding to the engaging claw, and the button is coupled to the handle through the engaging claw to be engaged with the engaging hole.

5. The direction-adjustable shower head fixing structure as claimed in claim 1, wherein an inner wall of the receiving hole of the ball seat has a curved surface.

6. The direction-adjustable shower head fixing structure as claimed in claim 1, wherein a limiting block is provided in the receiving hole of the ball seat, a bottom of the ball head is provided with a limiting groove, the limiting groove and the limiting block are configured to limit a relative rotation range of the ball head.

7. The direction-adjustable shower head fixing structure as claimed in claim 1, wherein a top of the button is exposed outside the shower head main body, and the shower head main body is provided with a button hole corresponding to the button.

8. The direction-adjustable shower head fixing structure as claimed in claim 1, wherein an inner wall of the receiving hole of the ball seat and the front end of the pressing portion of the handle are provided with anti-slip pads.

* * * * *